United States Patent [19]

Möller

[11] 4,395,982

[45] Aug. 2, 1983

[54] CASING MEMBER FOR ELEMENTS OF INTERNAL COMBUSTION ENGINES

[75] Inventor: Heribert Möller, Sachsen, Fed. Rep. of Germany

[73] Assignee: M.A.N. Maschinenfabrik Augsburg-Nürnberg AG, Nuremberg, Fed. Rep. of Germany

[21] Appl. No.: 266,170

[22] Filed: May 22, 1981

[30] Foreign Application Priority Data

Jun. 30, 1980 [DE] Fed. Rep. of Germany ..... 3024630

[51] Int. Cl.[3] ..... F01M 11/00

[52] U.S. Cl. ..... 123/195 C; 184/6.5; 184/106; 181/204; 123/198 E

[58] Field of Search ..... 123/195 R, 195 C, 198 E; 184/6.5, 106; 181/204

[56] References Cited

U.S. PATENT DOCUMENTS

| | | | |
|---|---|---|---|
| 1,200,172 | 10/1916 | Danver | 184/106 |
| 1,892,185 | 12/1932 | Clements | 184/106 |
| 4,296,716 | 10/1981 | Hofbauer et al. | 123/195 C |

*Primary Examiner*—Craig R. Feinberg

*Attorney, Agent, or Firm*—Kontler, Grimes & Battersby

[57] ABSTRACT

A noise-reducing casing member for oil-containing elements of interval combustion engines. The walls of the casing member are converging stepped plates containing inward depressions and/or grooves for frequency detuning.

4 Claims, 3 Drawing Figures

FIG. 1
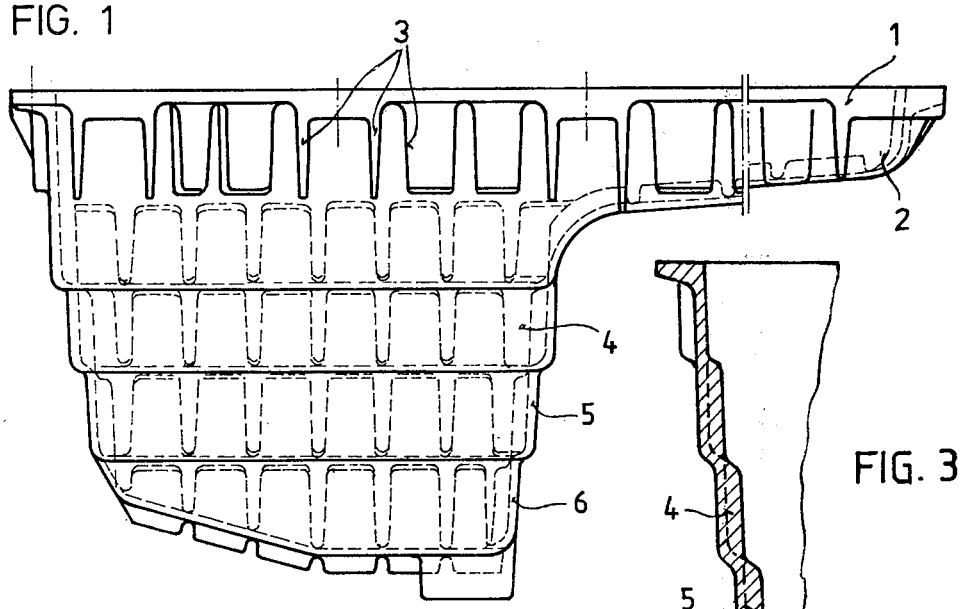
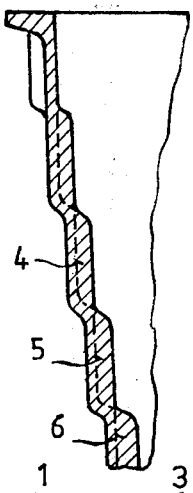
FIG. 3
FIG. 2
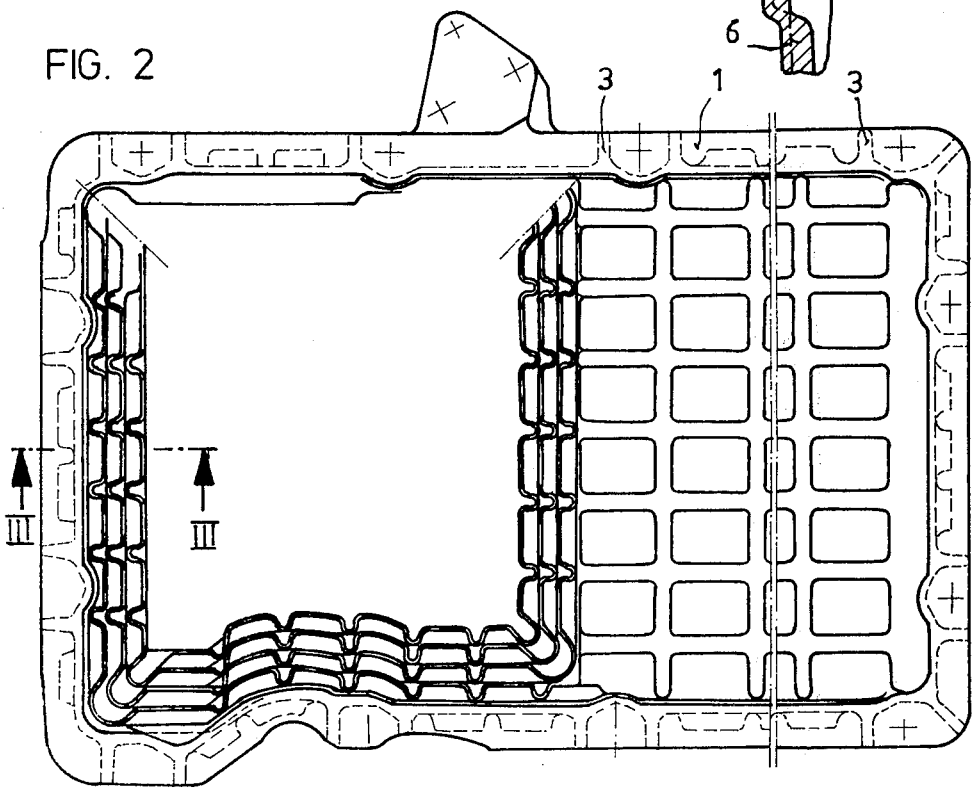

CASING MEMBER FOR ELEMENTS OF INTERNAL COMBUSTION ENGINES

The present invention relates to a casing member on internal combustion engines for the noise-reducing enclosure of oil-containing engine elements. Typically, the invention is intended for oil sumps on vehicle engines or similar applications.

Environmental protection legislation requires the makers of internal combustion engines to comply with specified noise emission levels. Although the laws are generally directed at the complete vehicle or equipment containing the engine, it will be appreciated that the engine itself generally accounts for the greater proportion of the total noise emission. Therefore, it is desirable to quiet the engine as the main noise source.

Broadly, there are two possible ways of achieving the object of noise damping.

One way would be to completely enclose the engine itself, with an accoustic shielding. Such an acoustic shielding would be effective only if it is made to fit as tightly as possible and if it is completely insulated against all vibrating engine parts. In the case of an internal combustion engine, it is also necessary for the shielding to be fuel and oil-proof and to withstand the high working temperatures, especially in the area of the exhaust manifold.

It is in particular the latter requirements that have prevented the use on internal combustion engines of noise-damping features made of plastic as known elsewhere in vehicle construction and, in particular, in conjunction with electric motors. For instance, the German Preliminary Specification No. 26 17844 disclosed noise damping for vehicle components, specifically for the drive motor of windscreen wipers, using a plastic container of relatively soft plastic reinforced by means of stiffening ribs. Such protection is however ruled out for an oil sump or similar applications by the reasons indicated above.

A second way of reducing noise emission is in controlling noise directly at the primary features of internal combustion engines which are source of the noise. Typical sources of noise include the crankcase, the oil sump, valve covers and timing case cover.

It is the object of the present invention to provide a casing member for the purposes indicated in the form of a casting which will prevent or effectively dampen the transmission of structure-borne and air-borne sound waves such as arise inside an internal combustion engine and cannot be prevented there in view of the high accelerations and the rotating masses and which, in particular, do not emit any natural frequencies.

According to the invention, the casing member is formed with grooved and/or step-shaped walls. As a result, the stiffness in bending and the plate mass are changed in a manner that frequency detuning is obtained from the audible range which alone is felt to be a source of annoyance.

The invention starts from the realization that casing members with a large surface, if they are not subdivided as proposed by the invention in the fashion of a lattice and/or trapezoidal form, will act as a membrane which, even though dampened, can easily be excited to produce natural vibrations and, on the other hand, represents an effective radiation surface (secondary noise source) for the sound waves produced in the interior of the casing.

As a result of the feature of the invention, viz to form the casing member, typically the oil sump, with a grooved and/or step-shaped mass structure, a substantial advantage is obtained for production in that a casting formed in this manner can be directly molded and produced without any difficulties both as a sand or die casting. The splitting of the pattern required hitherto for such castings, both for the outer part and the inner part can be dispensed with.

It is recommended in particular to produce the casting in this form by the die-casting process in order to be able to produce higher quantities at reasonable cost. Due to the fact that the outer contour is closed according to the invention, movable helpers in the mould may be omitted so that the size of the die-casting equipment itself will be much smaller. This in turn will result in lower tool costs, longer tool life and the omission of flash removal work which would be necessary where the pattern is divided. Savings in costs for the tools would be of the order of 40 to 50%.

A typical embodiment of a casing member having the features according to the invention in the form of an oil sump is explained in the following description in conjunction with the accompanying drawing in which:

FIG. 1 is a side elevation of a typical form of an oil sump with the features of the invention;

FIG. 2 is a plan view of the oil sump in FIG. 1; and

FIG. 3 is a section along the line of III—III through the oil sump according to FIG. 2.

The oil sump shown in the drawing which is used in a known manner to close the crankcase of an internal combustion engine at the bottom, is formed with a connecting flange 1 which (in a manner not shown) is provided with holes for connecting screws and bolts around its circumference. This flange 1 adjoins the upper part 2 of the sump and, according to the invention, is provided with a plurality of ribs and/or corrugations 3 in order to prevent a uniform noise radiation surface in contrast to conventional oil sumps. These ribs and/or projections will detune the natural frequency of this sump section in a manner that, as mentioned, a natural vibration is precluded in the audible range.

The part extending downwards to enclose the bottom of the crank case is formed in line with the concept of the invention explained above with a stepped shape, the embodiment selected having a total of three steps. The surface of each individual step is provided with inward depressions or grooves over its full circumference so that in this area, too, a mass structure results which is capable neither of transmitting sound waves from the interior of the engine case nor tends to produce natural vibrations in the audible range.

Referring to the drawing, the three steps 4, 5, 6 are schematically shown, the wall in each individual step being corrugated according to the above-mentioned proposal, i.e. the wall is regularly interrupted by corrugations. The wall thickness in the area of the corrugations is identical with the wall thickness existing in the other remaining parts of the wall.

The bottom surfaces both of the upper part 2 and of the last step 6 of the deep portion are formed with a reticulated pattern with the corrugations or grooves being arranged perpendicular to each other so that relatively small, substantially square, remaining surfaces exist which have a vibration behaviour above the auditory range.

It was mentioned earlier that, as can be seen from the typical embodiment reproduced, such a casting lends itself very well to molding and casting.

It is obvious from the foregoing that variations are possible both in designing the surfaces on the sides and the bottom surfaces, the important thing being to see to it that the above mentioned requirements for noise control are attained. In particular, it is also possible to vary the vibration behaviour of the individual surfaces by means of stiffening ribs and thereby to avoid noise emission in the auditory range.

It may be pointed out at this juncture that reenforcing ribs have occasionally been provided and proposed for casing members, specifically plastic casings. The stiffening ribs provided there were mainly intended to reinforce the inherently soft material which as such is not conducive to the transmission of vibrations. According to the present invention, the ribs are provided in order to control vibration behaviour.

The proposal according to the invention can be directly applied not only to oil sumps, but also to other casing members on internal combustion engines, such as valve covers, etc. The metal or metal alloy used is no factor. The only thing to be borne in mind in providing grooves, ribs or corrugations is to ensure that the remaining parts of the wall cannot vibrate in the auditory range.

I claim:

1. A cast, noise-reducing casing member for enclosing oil-containing elements of internal combustion engines comprising at least two wall layers arranged in stepped relationship to one another, each said wall layer having a first surface comprising first spaced outer raised portions and first inwardly depressed portions spaced between said respective raised portions, wherein said wall layers form structure means which effects frequency detuning outside auditory range.

2. The casing member of claim 1, one of said wall layers further having a second planar surface and said second planar surface comprising second spaced raised portions and a reticulated pattern of intersecting second inwardly depressed portions spaced between said respective second raised portions.

3. The casing member of claim 1, one of said wall layers further having a third planar surface and said third planar surface comprising third spaced raised portions and a reticulated pattern of intersecting stiffening ribs extending between said respective third raised portions.

4. The casing member of claim 1, wherein all portions of said wall layers are of constant thickness.

* * * * *